US010648724B2

(12) United States Patent
Quinlan et al.

(10) Patent No.: US 10,648,724 B2
(45) Date of Patent: May 12, 2020

(54) COLD PLATE SHELF ASSEMBLY FOR A REFRIGERATOR

(71) Applicant: Whirlpool Corporation, Benton Harbor, MI (US)

(72) Inventors: Daniel H. Quinlan, Stevensville, MI (US); Jose Angel Avalos, Montery (MX); Yifan Wang, St. Joseph, MI (US); Jason Ammerman, Chicago, IL (US); Christopher L. Carpenter, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 9 days.

(21) Appl. No.: 15/696,726

(22) Filed: Sep. 6, 2017

(65) Prior Publication Data

US 2018/0066884 A1 Mar. 8, 2018

Related U.S. Application Data

(60) Provisional application No. 62/383,886, filed on Sep. 6, 2016.

(51) Int. Cl.
*F25D 17/06* (2006.01)
*F25D 25/02* (2006.01)

(52) U.S. Cl.
CPC ..... *F25D 17/062* (2013.01); *F25D 25/02* (2013.01); *F25D 25/028* (2013.01); *F25D 2317/067* (2013.01); *F25D 2325/022* (2013.01)

(58) Field of Classification Search
CPC ..... F25D 17/00; F25D 17/06; F25D 17/062; F25D 25/02; F25D 25/028; F25D 2325/022; F25D 2317/067
USPC ..... 62/404, 407, 419, 287
See application file for complete search history.

(56) References Cited

U.S. PATENT DOCUMENTS

| | | | | |
|---|---|---|---|---|
| 2,775,873 | A | 1/1957 | Jones | |
| 3,055,642 | A | 9/1962 | Cox et al. | |
| 3,090,211 | A | 5/1963 | Barroero | |
| 3,096,628 | A | 7/1963 | Beckett et al. | |
| 4,459,826 | A * | 7/1984 | Hirano | F25D 11/006 62/276 |
| 4,671,074 | A | 6/1987 | Gostelow et al. | |
| 5,720,185 | A | 2/1998 | Lee | |
| 5,722,252 | A | 3/1998 | Kang et al. | |

(Continued)

*Primary Examiner* — Keith M Raymond
*Assistant Examiner* — Gustavo A Hincapie Serna
(74) *Attorney, Agent, or Firm* — Diederiks & Whitelaw, PLC.

(57) ABSTRACT

A refrigerator includes a refrigerated compartment, at least one door that selectively seals the refrigerated compartment and a cold plate shelf assembly mounted in the refrigerated compartment. The shelf assembly includes a front trim, a rear trim and a first plate directly coupled to the front trim and the rear trim. A second plate extends from the front trim to the rear trim, the second plate being positioned so that a food item supported on the shelf assembly contacts the second plate. The second plate is made from a material having a higher thermal conductivity than glass. In one arrangement, the refrigerator further includes an air duct having an air vent. Air exiting the air duct through the air vent either impinges on and travels across the second plate or enters an interior of the shelf assembly.

23 Claims, 8 Drawing Sheets

(56) References Cited

U.S. PATENT DOCUMENTS 6,062,037 A 5/2000 Yoon
6,105,233 A * 8/2000 Neal ..... F25D 25/02 29/451
6,604,377 B2 8/2003 Watanabe et al.
6,612,116 B2 9/2003 Fu et al.
6,742,344 B2 6/2004 Vormedal
7,263,856 B2 * 9/2007 Choi ..... F25D 17/045 62/408
7,338,180 B2 3/2008 Wing
7,357,000 B2 4/2008 Schwichtenberg et al.
8,161,766 B2 4/2012 Shin et al.
8,261,572 B2 * 9/2012 Nojima ..... F25D 17/065 62/419
8,534,783 B2 * 9/2013 Nash ..... F25D 25/02 108/108
8,966,932 B2 * 3/2015 Lee ..... F25D 11/006 312/408
9,345,326 B2 * 5/2016 Sankhgond ..... A47B 96/024
9,486,078 B2 * 11/2016 Mobley ..... A47B 96/024
9,513,048 B2 * 12/2016 Choo ..... F25D 25/02
2006/0070395 A1 * 4/2006 Lee ..... F25D 17/045 62/408
2009/0064707 A1 * 3/2009 Smith ..... F25D 11/006 62/465
2010/0024446 A1 * 2/2010 Rohrer ..... A47F 3/0447 62/89
2010/0162745 A1 * 7/2010 Kim ..... F25D 25/025 62/407
2014/0138337 A1 5/2014 Curdt et al.
2015/0124453 A1 * 5/2015 McMillin ..... A47B 96/027 362/253
2015/0255193 A1 * 9/2015 Hammond ..... F21V 33/0044 362/92
2015/0316314 A1 * 11/2015 Bassler ..... F25D 23/08 312/408
2016/0097578 A1 * 4/2016 Hyun ..... F25D 17/062 62/96
2016/0174712 A1 * 6/2016 Jenkinson ..... F25D 25/02 211/186
2016/0282037 A1 * 9/2016 Han ..... F25D 23/00
2016/0327259 A1 * 11/2016 Pan ..... F21V 33/0044
2017/0214277 A1 * 7/2017 Lee ..... H02J 50/12

* cited by examiner

COLD PLATE SHELF ASSEMBLY FOR A REFRIGERATOR

CROSS REFERENCE TO RELATED APPLICATIONS

This application claims the benefit of U.S. Provisional Application No. 62/383,886, which was filed on Sep. 6, 2016 and titled "Cold Plate Shelf Assembly for a Refrigerator". The entire content of this application is incorporated herein by reference.

BACKGROUND OF THE INVENTION

The present invention pertains to the art of refrigeration and, more particularly, to a cold plate shelf assembly for use in a refrigerator.

In a typical refrigerator, food items are supported on transparent glass shelves. Although the use of glass allows light to pass through the shelves such that food items throughout the refrigerator are more readily visible, glass is not as thermally conductive as certain other materials, such as metals. As a result, a glass shelf will not help cool a food item placed thereon to the same degree that a metal shelf would, for example. In certain situations, refrigerator shelves do not need to be made from glass to provide sufficient light throughout a refrigerator. For example, lights can be incorporated into the refrigerator shelves, as in U.S. Pat. No. 7,338,180, such that light is provided to the area below each shelf. Furthermore, light does not need to pass through every shelf of a refrigerator. For example, it is often not necessary for light to pass through the bottommost shelf of a refrigerator or through a shelf located above a drawer.

In view of the above, it is considered beneficial to provide non-glass shelves that help chill food items placed thereon in situations where transparent glass shelves are not needed for sufficient light to be provided within a refrigerator. Preferably, the non-glass shelves are cooled not just by the standard circulation of cool air within the refrigerator but also by an additional cooling means so that food items placed on the shelves are chilled more quickly.

SUMMARY OF THE INVENTION

The present invention is directed to a refrigerator comprising a refrigerated compartment and a door configured to selectively seal the refrigerated compartment wherein a cold plate shelf assembly is mounted in the refrigerated compartment. The shelf assembly includes a front trim, a rear trim and a first plate directly coupled to the front trim and the rear trim. A second plate extends from the front trim to the rear trim, the second plate being positioned so that a food item supported on the shelf assembly contacts the second plate. The second plate is made from a material having a higher thermal conductivity than glass. In one embodiment, the refrigerator further comprises an air duct including an air vent. The air duct is configured so that air exiting the air duct through the air vent either impinges on and travels across the second plate or enters an interior of the shelf assembly.

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE PREFERRED EMBODIMENTS

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to employ the present invention.

Figure 1:
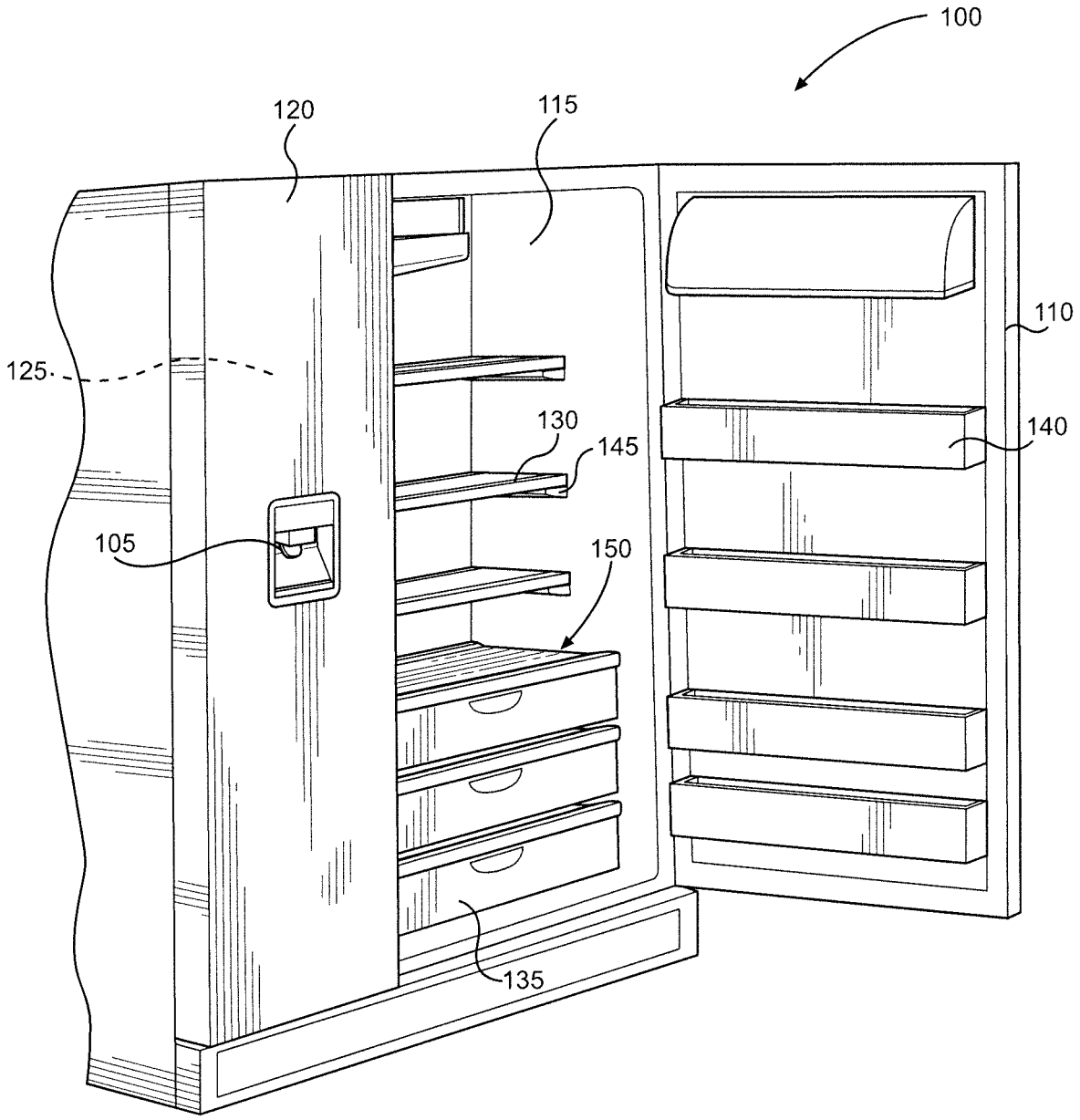
FIG. 1 is a perspective view of a refrigerator constructed in accordance with a first embodiment of the present invention.

With initial reference to FIG. 1, there is illustrated a refrigerator 100 constructed in accordance with a first embodiment of the present invention. Refrigerator 100 is shown in a side-by-side configuration, although the present invention can be used with other refrigerator configurations, including French door, bottom mount and top mount refrigerators. Refrigerator 100 includes a dispenser 105, which selectively dispenses ice or water when desired by a user; a fresh food door 110, which selectively seals a fresh food compartment 115; and a freezer door 120, which selectively seals a freezer compartment 125. Refrigerator 100 also includes a plurality of shelves (one of which is labeled 130), a plurality of drawers (one of which is labeled 135) and a plurality of door bins (one of which is labeled 140). The shelves are supported on a corresponding plurality of rails (one of which is labeled 145), which are preferably formed integrally with the side walls of fresh food compartment 115 during a thermoforming process. As illustrated, each shelf 130 extends across an entire width of fresh food compartment 115 (aside from certain small gaps between adjacent structure). However, some or all of the shelves can also be placed side-by-side such that each shelf extends across a half, a third or a quarter of the width of fresh food compartment 115, for example. Refrigerator 100 further includes a cold plate shelf assembly 150 that has structural and functional similarities to the shelves 130, as will be described below. Although not visible, refrigerator 100 also includes a refrigeration system that establishes above and below freezing temperatures in compartments 115 and 125, respectively. In other words, the refrigeration system cools the refrigerated compartments 115 and 125 of refrigerator 100.

Figure 2:
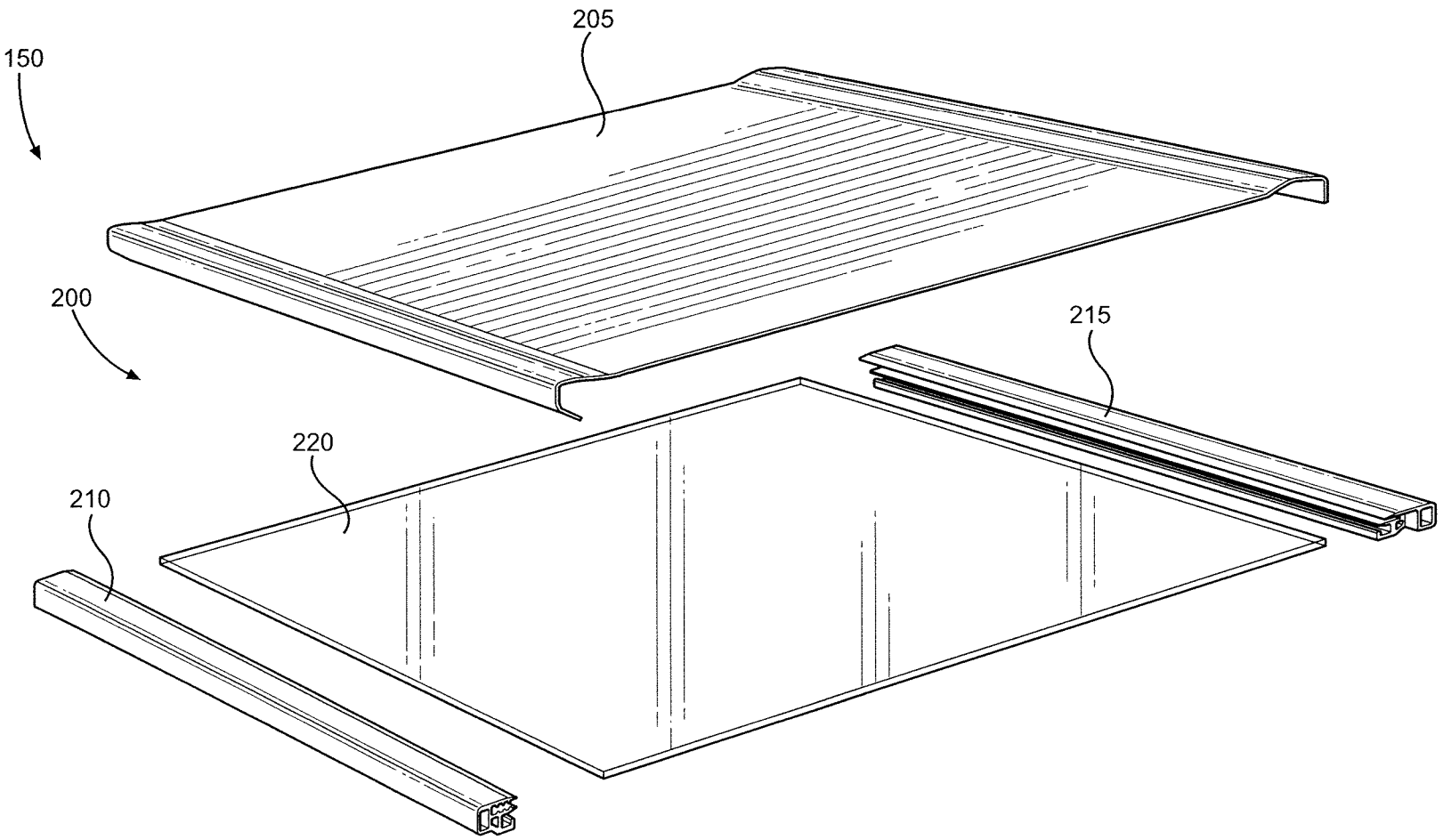
FIG. 2 is an exploded view of a cold plate shelf assembly of the refrigerator of FIG. 1.

With reference now to FIG. 2, an exploded view of cold plate shelf assembly 150 is provided. Shelf assembly 150 includes a shelf 200 and a cold plate 205. As is known in the art, shelf 200 includes a front trim 210 and a rear trim 215 that are directly coupled to a transparent glass plate 220. Ordinarily, food items would be supported within refrigerator 100 by placing them in contact with, i.e., directly upon, plate 220, while the use of glass for plate 220 allows light to pass through shelf 200 such that fresh food compartment 115, for example, can be fully illuminated. In the present case, however, cold plate 205 is directly coupled to shelf 200. Specifically, cold plate 205 is positioned above plate 220 and extends from front trim 210 to rear trim 215 so that food items are supported directly on cold plate 205 rather than on plate 220. Cold plate 205 is constructed from a metal or some other opaque material having a higher thermal conductivity than glass. Accordingly, light cannot pass through shelf assembly 150 (although this is not problematic since shelf assembly 150 is located above a drawer in refrigerator 100). In general, glass has a thermal conductivity of roughly 1 W/(m·K) at the temperatures found in domestic refrigerators. Accordingly, the thermal conductivity of the material used for cold plates 205 and 500 is preferably greater than 1 W/(m·K) at these temperatures and more preferably significantly greater than 1 W/(m·K), e.g., greater than 25, 50, 100 or 200 W/(m·K). In one embodiment, cold plates 205 and 500 are made from aluminum or an aluminum alloy. With respect to the increased thermal conductivity, this results in a better transfer of heat between cold plate 205 and a food item placed in contact with cold plate 205. Since cold plate 205 is located within fresh food compartment 115, cold plate 205 is chilled by the circulation of cool air within refrigerator 100. If a relatively warmer food item is placed in contact with cold plate 205, heat is transferred from the food item to cold plate 205. While this would also occur if the food item were placed in contact with glass plate 220, the use of a material having a higher thermal conductivity than glass means that the food item is chilled more rapidly when placed in contact with cold plate 205.

Figure 3A:
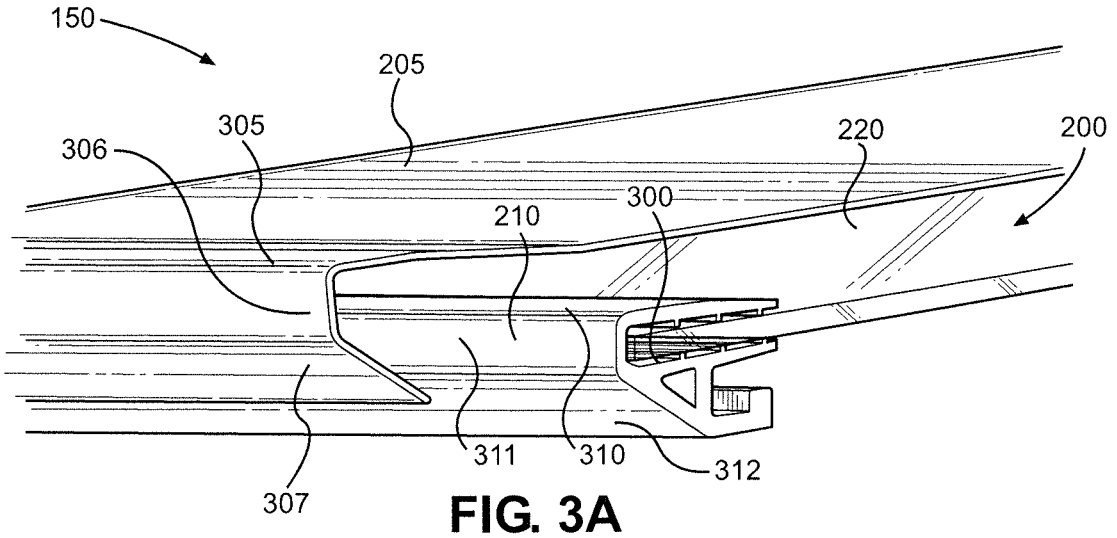
FIG. 3A illustrates a first step in assembling the cold plate shelf assembly.
Figure 3B:
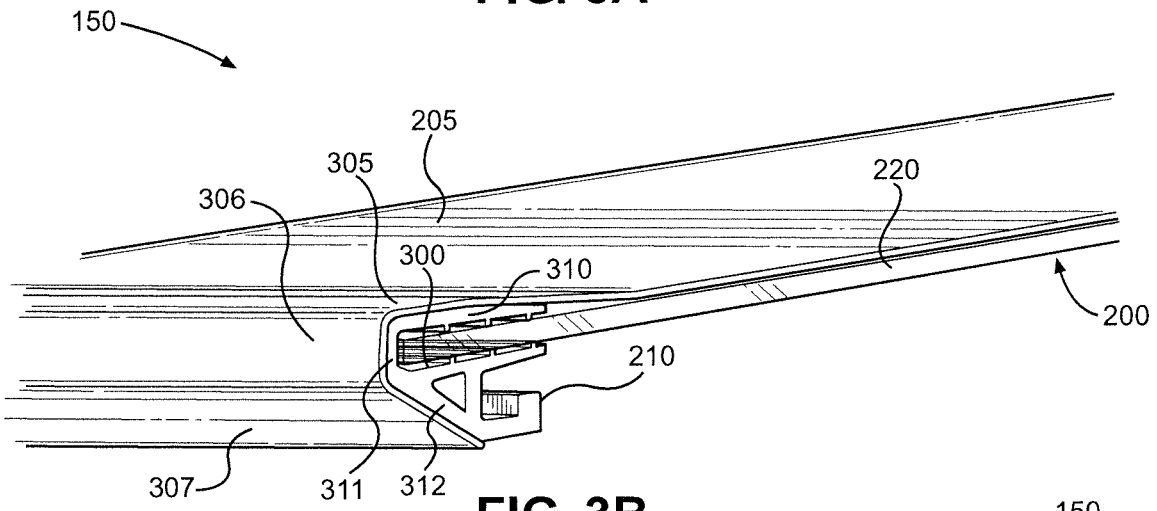
FIG. 3B illustrates a second step in assembling the cold plate shelf assembly.
Figure 3C:
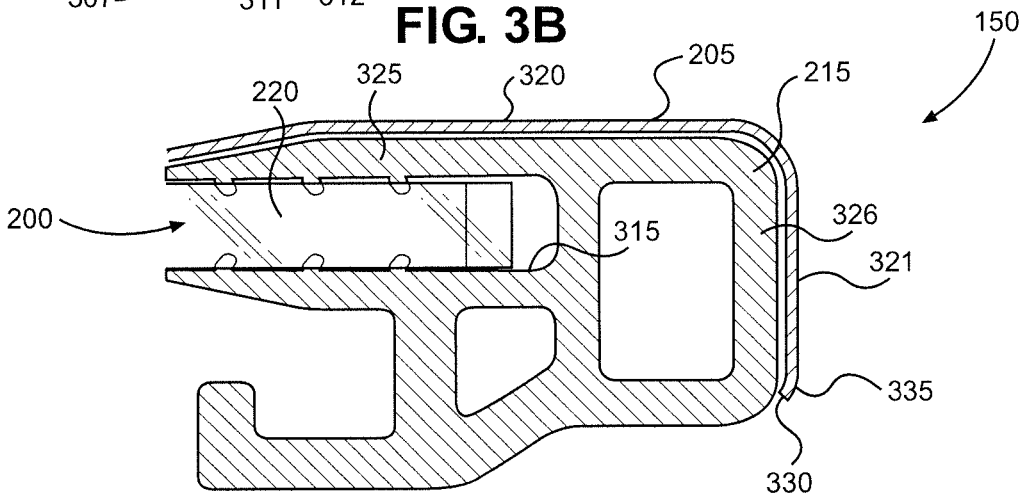
FIG. 3C illustrates a third step in assembling the cold plate shelf assembly.

FIGS. 3A-C illustrate the steps by which shelf assembly 150 is assembled. As can be seen in FIG. 3A, glass plate 220 is received in a U-shaped channel 300 of front trim 210. Glass plate 220 can be secured to front trim 210 by glue, for example. The shape of cold plate 205 conforms to and matches that of front trim 210 such that a top portion 305, a front portion 306 and an angled portion 307 of cold plate 205 contact a top portion 310, a front portion 311 and an angled portion 312 of front trim 210, respectively, when cold plate 205 is brought into contact with front trim 210, as shown in FIG. 3B. In addition, cold plate 205 is in contact with glass plate 220. Turning to FIG. 3C, it can be seen that glass plate 220 is also received in a U-shaped channel 315 of rear trim 215. As with front trim 210, glass plate 220 can be secured to rear trim 215 by glue, for example. The shape of cold plate 205 also conforms to and matches that of rear trim 215 such that a top portion 320 and a rear portion 321 of cold plate 205 contact a top portion 325 and a rear portion 326 of rear trim 215, respectively, when cold plate 205 is brought into contact with rear trim 215. An end 330 of rear portion 321 of cold plate 205 has a short-radius curve 335. In combination with angled portion 307 of cold plate 205, short-radius curve 335 secures cold plate 205 to shelf 200. Specifically, angled portion 307 is angled rearward and downward, while short-radius curve is angled frontward and downward, such that cold plate 205 wraps around shelf 200 to retain cold plate 205 in place. During assembly of shelf assembly 150, cold plate 205 is first brought into contact with front trim 210 before being snapped into place using short-radius curve 335. Optionally, glue or tape can also be used to help secure cold plate 205 to shelf 200.

Figure 4:
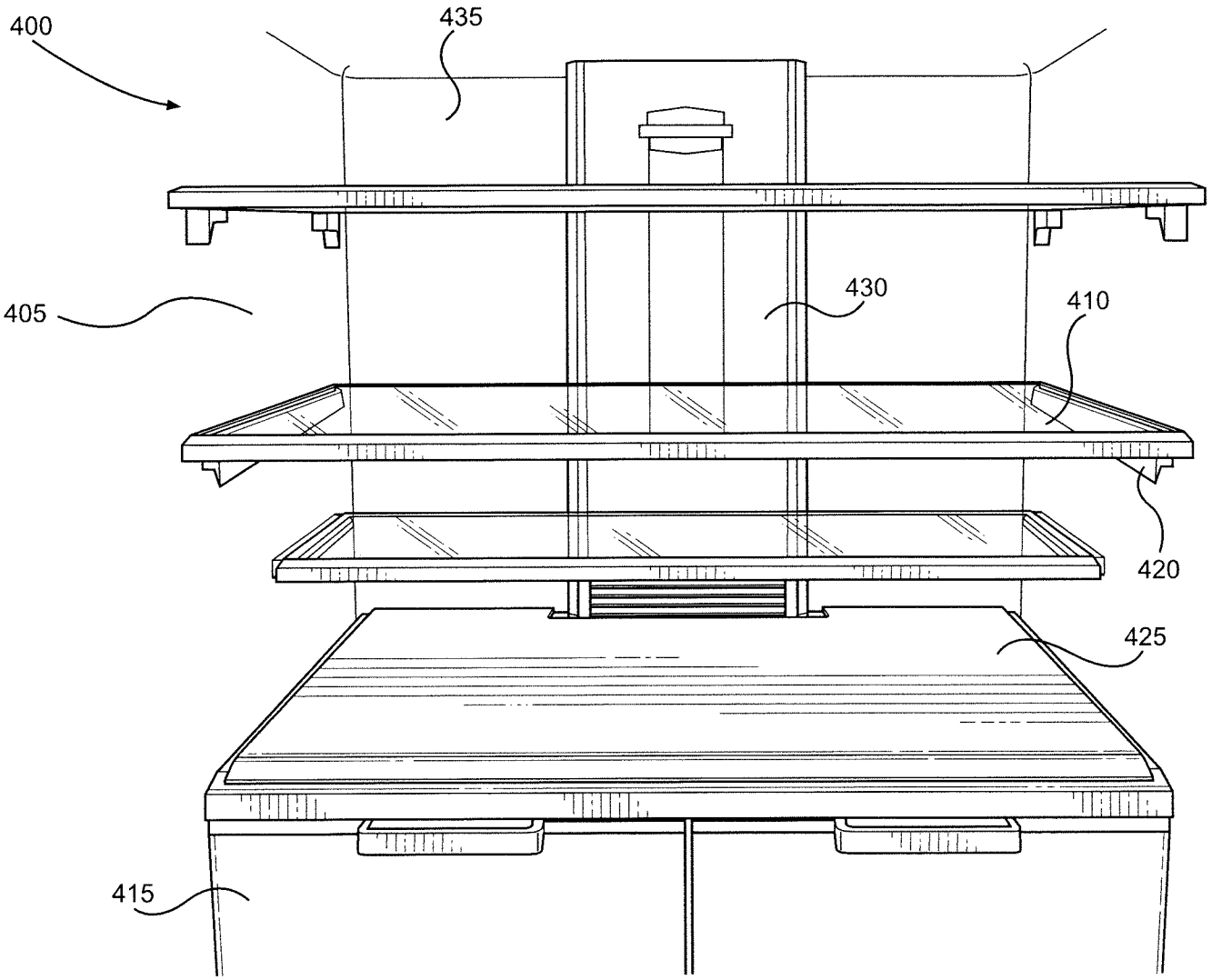
FIG. 4 is a front perspective view of a refrigerator constructed in accordance with a second embodiment of the present invention.

With reference now to FIG. 4, there is illustrated a refrigerator 400 constructed in accordance with a second embodiment of the present invention. Refrigerator 400 is shown in a French door configuration. However, as noted above in connection with the first embodiment, the present invention can be used with a variety of refrigerator configurations. Although not visible, refrigerator 400 can include a dispenser, which selectively dispenses ice or water when desired by a user, as well as fresh food doors which selectively seal a fresh food compartment 405, and a freezer door or drawer for a freezer compartment. Refrigerator 400 also includes a plurality of shelves (one of which is labeled 410), a plurality of drawers (one of which is labeled 415) and a plurality of door bins (not visible). The shelves 410 are supported on a corresponding plurality of rails (one of which is labeled 420), which are preferably formed integrally with the side walls of fresh food compartment 405 during a thermoforming process. As illustrated, each shelf 410 extends across an entire width of fresh food compartment 405 (aside from certain small gaps between adjacent structure). However, some or all of the shelves can also be placed side-by-side such that each shelf extends across a half, a third or a quarter of the width of fresh food compartment 405, for example. Refrigerator 400 further includes a cold plate shelf assembly 425 and an air duct (or tower) 430, which runs along and is in contact with a rear wall 435 of fresh food compartment 405. Although not visible, refrigerator 400 also includes a refrigeration system that establishes above and below freezing temperatures in fresh food compartment 405 and the freezer compartment, respectively. In other words, the refrigeration system cools the refrigerated compartments of refrigerator 400.

Figure 5A:
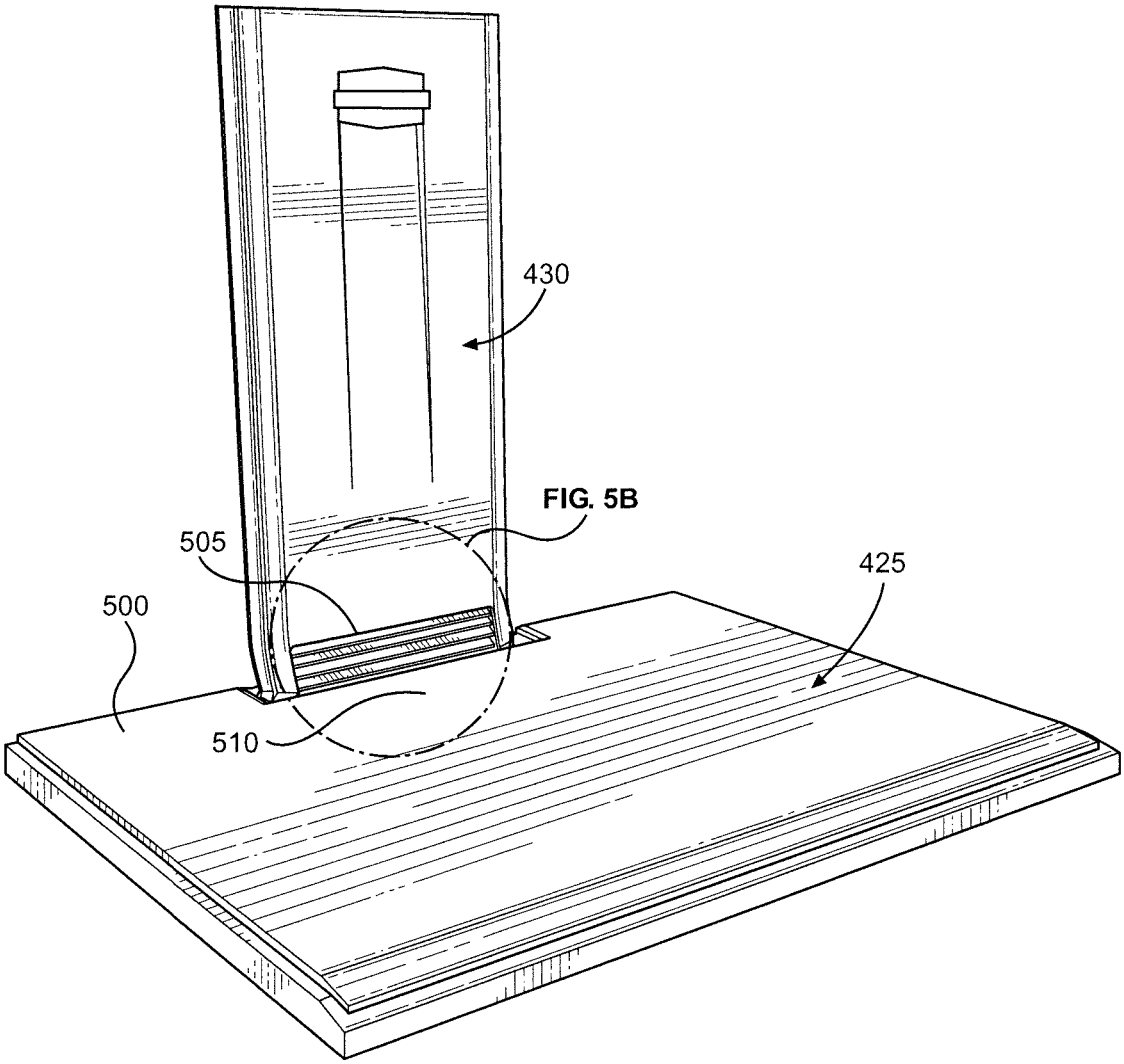
FIG. 5A is a perspective view of an air duct and cold plate shelf assembly of the refrigerator of FIG. 4.
Figure 5B:
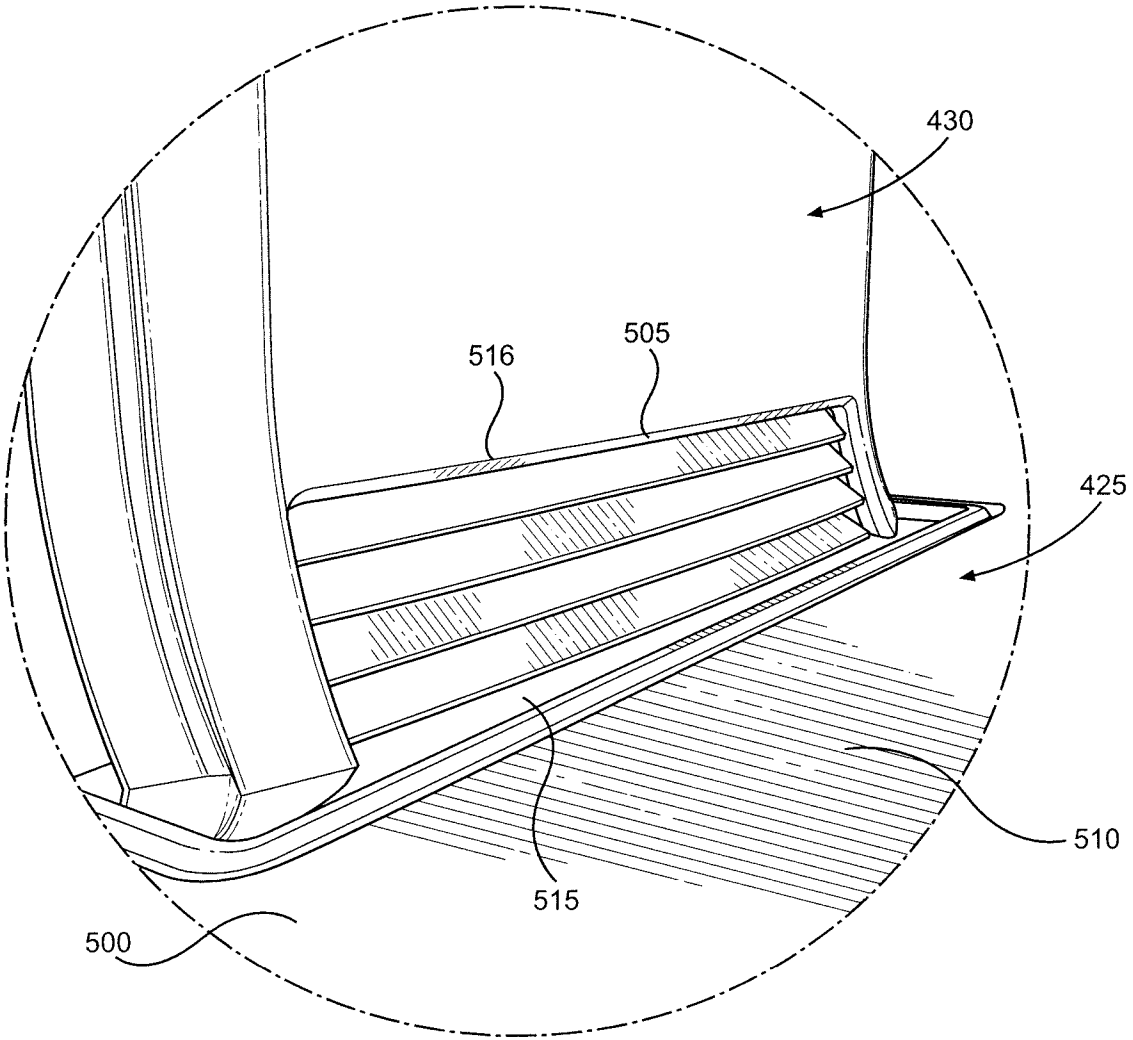
FIG. 5B is an enlarged view of a portion of FIG. 5A.

FIG. 5A shows shelf assembly 425 and air duct 430 separate from the rest of refrigerator 400. In general, shelf assembly 425 functions in the same manner as shelf assembly 150. That is, shelf assembly 425 includes a cold plate 500 made from a metal or another material having a higher thermal conductivity than glass. As a result, heat is more rapidly transferred to cold plate 500 than to an equivalent glass shelf when a food item is placed thereon. In other words, the food item is chilled relatively more quickly when placed on cold plate 500. This improved cooling ability is further enhanced by the inclusion of air duct 430. Cool air generated by the refrigeration system of refrigerator 400 is directed through air duct 430 and into fresh food compartment 405. Air duct 430 includes a vent 505 positioned so that cool air exiting vent 505 impinges on and travels across an upper surface 510 of cold plate 500, as can be seen in more detail in FIG. 5B. Specifically, a bottom edge 515 of vent 505 is located roughly level with (e.g., exactly level with or just above or below) upper surface 510. A top edge 516 of vent 505 is located above upper surface 510. Just as the use of a material having a higher thermal conductivity provides more rapid heat transfer between cold plate 500 and a food item placed thereon, it also provides more rapid heat transfer between cold plate 500 and the air adjacent to cold plate 500. Accordingly, heat is drawn from cold plate 500 as the cool air from vent 505 flows across cold plate 500, thereby rapidly lowering the temperature of cold plate 500. This enhances the ability of cold plate 500 to chill food items.

Figure 6A:
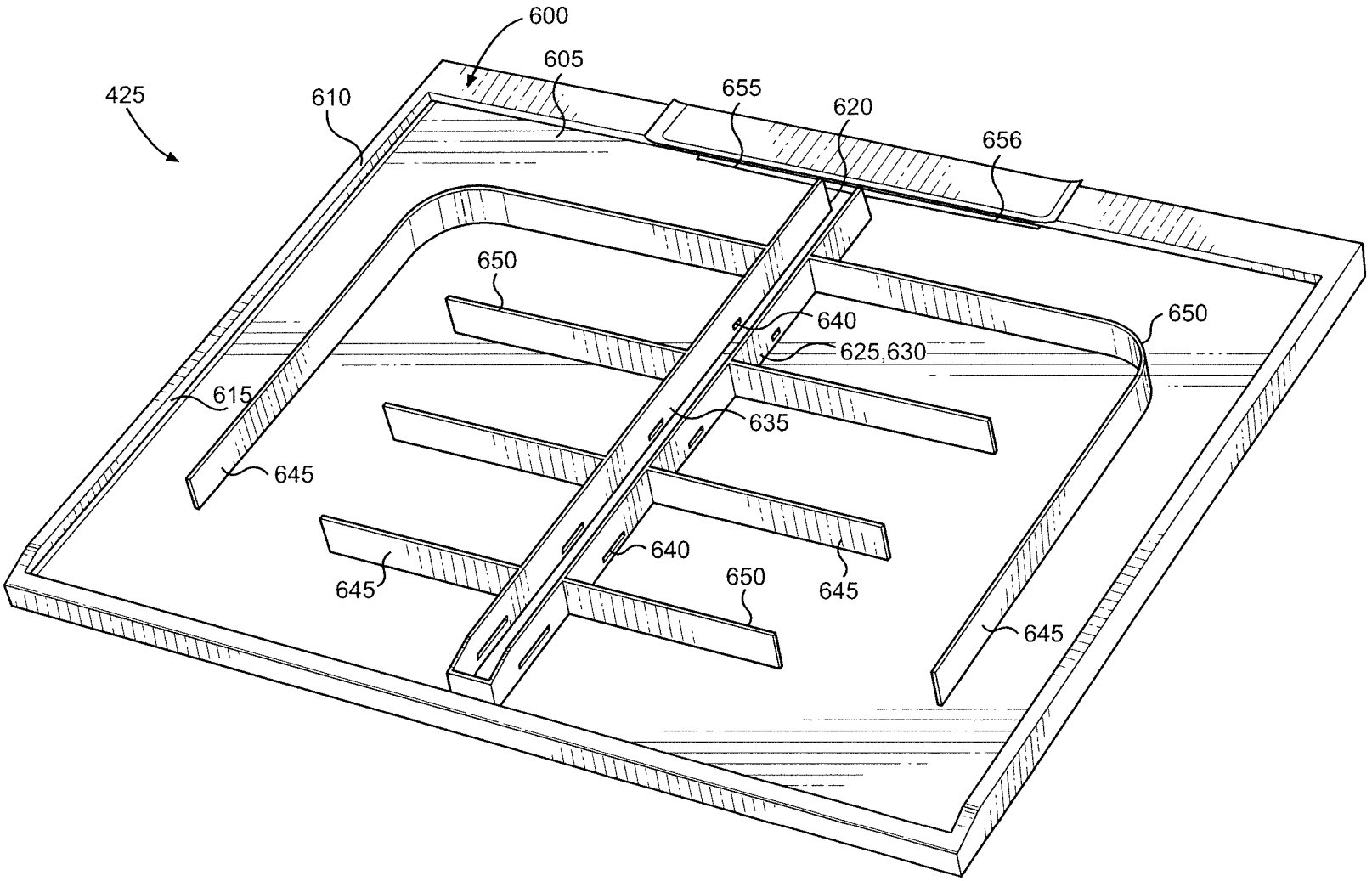
FIG. 6A is a perspective view of an airflow arrangement provided in connection with the shelf assembly of the invention.
Figure 6B:
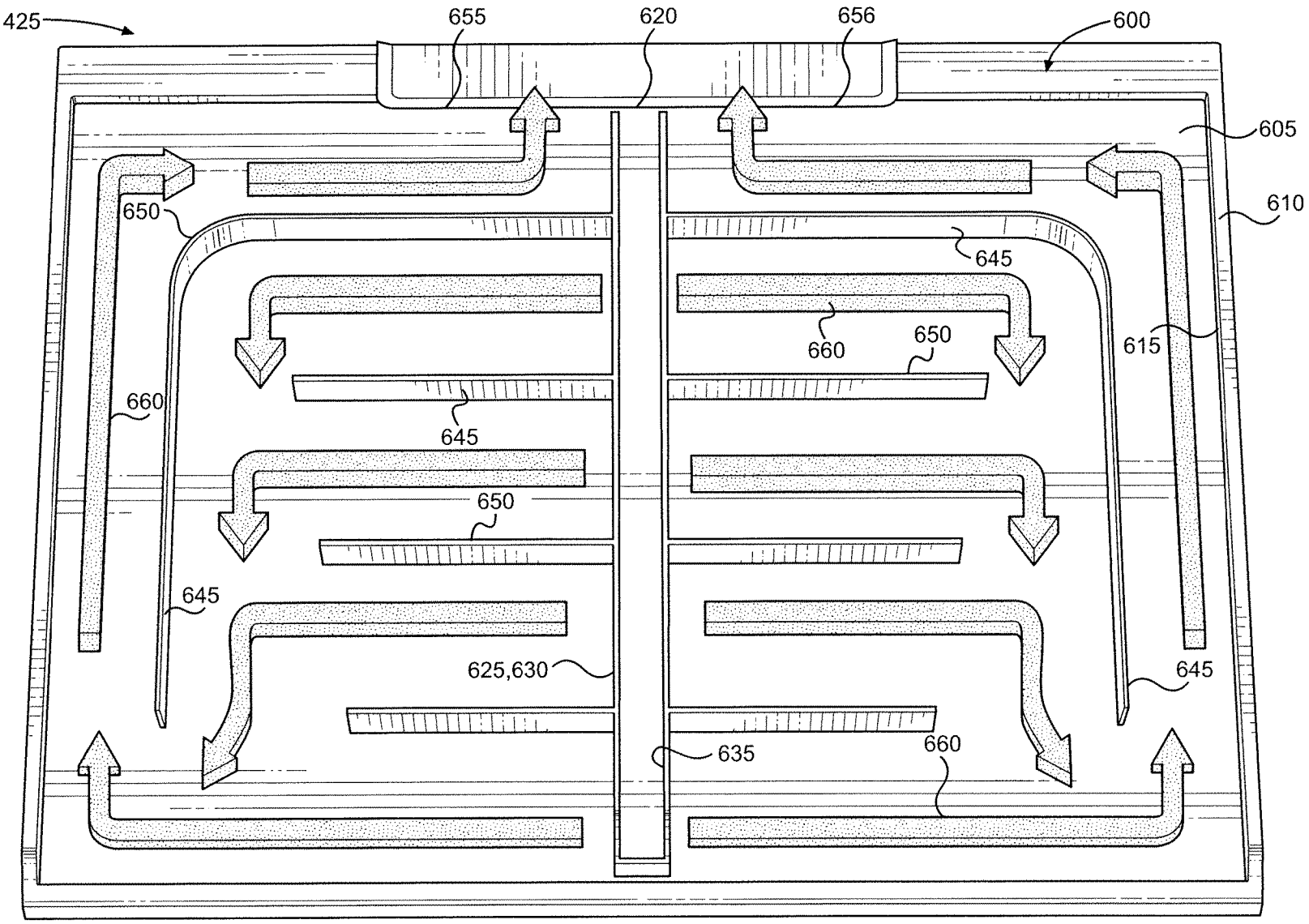
FIG. 6B illustrates a preferred flow of air for the shelf assembly of FIG. 6A.

FIGS. 6A and 6B show shelf assembly 425 with cold plate 500 removed so that the interior of shelf assembly 425 is visible. Shelf assembly 425 includes a frame 600 to which cold plate 500 is directly coupled. Frame 600 has a bottom wall or plate 605, which can be established by a transparent material such as glass, and a vertical wall 610 extending upward from bottom wall 605. Together, cold plate 500, bottom wall 605 and vertical wall 610 define a cavity 615 within shelf assembly 425. Cool air can be directed from air duct 430 into the interior of shelf assembly 425, i.e., into cavity 615. This can take place in addition to or instead of the cool air being directed onto cold plate 500 by vent 505. In either case, the cool air is directed through a vent in the front of air duct 430 (not shown) and into an inlet 620 in the rear of shelf assembly 425. The air will then travel through an air diffuser 625 located within cavity 615. Air diffuser 625 includes a vertical wall 630 defining a channel 635. A plurality of holes 640 is formed in wall 630. Air diffuser 625 is configured to direct the air entering inlet 620 along channel 635, through holes 640 and to a plurality of channels 645. Channels 645 are defined by a plurality of fins 650 extending vertically within cavity 615, with fins 650 serving to guide the flow of air within cavity 615. After passing through holes 640, the air travels along channels 645 and exits shelf assembly 425 through outlet 655 and 656 in the rear of shelf assembly 425. The air then reenters air duct 430. This airflow path is represented by a plurality of arrows 660 in FIG. 6B. It should however be recognized that a wide variety of different airflow paths can be used in connection with the present invention. These airflow paths can use one or more outlets at the front, rear and/or sides of shelf assembly 425.

Although vertical wall 610 is shown as a single wall extending along the front, side and rear edges of frame 600, vertical wall 610 can be made up of a plurality of walls. Also, air diffuser 625 and fins 650 can be formed integrally with cold plate 500. In such an arrangement, air diffuser 625 and fins 650 would be formed from the same material as cold plate 500 (i.e., a material having a higher thermal conductivity than glass). This increases the surface area of cold plate 500, thereby increasing the amount of heat that can be transferred from cold plate 500 to the air. Alternatively, air diffuser 625 and fins 650 can be formed integrally with frame 600. Air diffuser 625 and fins 650 can also be formed separately from both cold plate 500 and frame 600. In any of these arrangements, air diffuser 625 and fins 650 can be formed integrally with or separately from one another. Furthermore, air duct 430 can be used with shelf assembly 150, with vent 505 positioned such that air exiting vent 505 impinges on and travels across an upper surface of cold plate 205.

Despite the differences between cold plate shelf assemblies 150 and 425 and the other shelves located in refrigerators 100 and 400, shelf assemblies 150 and 425 still define food item supporting shelves. Accordingly, while shelf assemblies 150 and 425 are shown located immediately above drawers in refrigerators 100 and 400, shelf assemblies 150 and 425 can be placed in any suitable shelf location and used with or without additional lighting. Similarly, multiple cold plate shelf assemblies can be provided in a refrigerator. Preferably, shelf assemblies 150 and 425 are installed in the same manner as the other shelves, e.g., by supporting them on rails formed integrally with or coupled to the side or rear walls of fresh food compartments 115 and 405. Also, shelf assemblies 150 and 425 can be used in both fresh food and freezer compartments and can span the entire width of these compartment or some portion thereof.

Based on the above, it should be readily apparent that the present invention provides non-glass shelves that help chill food items placed thereon. The present invention further provides non-glass shelves that are cooled not just by the standard circulation of cool air within a refrigerator but also by an additional cooling means so that food items placed on the shelves are chilled more quickly. Although described with reference to preferred embodiments, it should be readily understood that various changes or modifications could be made to the invention without departing from the spirit thereof.

The invention claimed is:

1. A refrigerator comprising:
- a refrigerated compartment;
- at least one door configured to selectively seal the refrigerated compartment; and
- a cold plate shelf assembly mounted in the refrigerated compartment, wherein the cold plate shelf assembly includes:
  - a first plate made of glass and defining a top surface; and
  - a second plate extending across the top surface of the first plate such that a food item supported on the cold plate shelf assembly contacts the second plate, and wherein the second plate is made from a material having a higher thermal conductivity than glass and is in direct contact with the top surface of the first plate.

2. The refrigerator of claim 1, wherein the cold plate shelf assembly further includes front and rear trim, the first plate is directly coupled to the front and rear trim, and the second plate extends from the front trim to the rear trim.

3. The refrigerator of claim 2, wherein the second plate contacts the front and rear trim, and a shape of the second plate conforms to a shape of the front trim and a shape of the rear trim.

4. The refrigerator of claim 3, wherein a first top portion, a front portion and an angled portion of the second plate are in contact with a top portion, a front portion and an angled portion of the front trim, respectively, and a second top portion and a rear portion of the second plate are in contact with a top portion and a rear portion of the rear trim, respectively.

5. The refrigerator of claim 4, wherein an end of the rear portion of the second plate has a short-radius curve, and the short-radius curve and the angled portion of the second plate are configured to conform the second plate to a portion of the cold plate shelf assembly.

6. The refrigerator of claim 5, wherein the angled portion of the second plate is angled rearward and downward, and the short-radius curve is angled frontward and downward, such that the second plate wraps around the portion of the cold plate shelf assembly.

7. The refrigerator of claim 1, wherein the second plate is made from aluminum or an aluminum alloy.

8. The refrigerator of claim 1, wherein the second plate is made from a material having a thermal conductivity greater than 25 W/(m·K) at a temperature of the refrigerated compartment.

9. The refrigerator of claim 1, wherein the cold plate shelf assembly further includes an air duct including an air vent, wherein the air duct is configured so that air exiting the air duct through the air vent impinges on and travels across the second plate.

10. A refrigerator comprising:
- a refrigerated compartment;
- at least one door configured to selectively seal the refrigerated compartment;
- a cold plate shelf assembly mounted in the refrigerated compartment, wherein the cold plate shelf assembly includes a plate positioned so that a food item supported on the cold plate shelf assembly contacts the plate, and wherein the plate is made from a material having a higher thermal conductivity than glass; and an air duct including an air vent, wherein the air duct is configured so that air exiting the air duct through the air vent both impinges on and travels across the plate and enters an interior of the cold plate shelf assembly, a bottom edge of the air vent is located level with or below an upper surface of the plate, the bottom edge of the air vent is located above a bottom wall of the cold plate shelf assembly, and a top edge of the air vent is located above the upper surface of the plate.

11. The refrigerator of claim 10, wherein the cold plate shelf assembly further includes a frame having a bottom wall and a vertical wall extending upward from the bottom wall, and the plate, the bottom wall and the vertical wall define a cavity within the cold plate shelf assembly.

12. The refrigerator of claim 11, wherein the cold plate shelf assembly further includes an inlet in a rear of the cold plate shelf assembly such that air entering the interior of the cold plate shelf assembly enters the cavity through the inlet.

13. The refrigerator of claim 12, wherein the cold plate shelf assembly further includes a plurality of fins extending vertically within the cavity, and the plurality of fins defines a plurality of channels within the cavity.

14. The refrigerator of claim 13, wherein the plurality of fins is formed integral with the plate.

15. The refrigerator of claim 13, wherein the cold plate shelf assembly further includes an air diffuser located within the cavity, and the air diffuser is configured to direct air entering the inlet to the plurality of channels.

16. The refrigerator of claim 11, wherein the cold plate shelf assembly further includes an outlet in the rear of the cold plate shelf assembly such that air exiting the interior of the cold plate shelf assembly through the outlet enters the air duct.

17. The refrigerator of claim 10, wherein the plate is made from aluminum or an aluminum alloy.

18. The refrigerator of claim 10, wherein the plate is made from a material having a thermal conductivity greater than 25 W/(m·K) at a temperature of the refrigerated compartment.

19. A refrigerator comprising:

a refrigerated compartment;

at least one door configured to selectively seal the refrigerated compartment;

a first cold plate shelf assembly mounted in the refrigerated compartment, wherein the first cold plate shelf assembly includes:

a first plate made of glass and defining a top surface; and a second plate extending across the top surface of the first plate such that a food item supported on the first cold plate shelf assembly contacts the second plate, and wherein the second plate is made from a material having a higher thermal conductivity than glass and is in direct contact with the top surface of the first plate; and a second cold plate shelf assembly mounted in the refrigerated compartment, wherein the second cold plate shelf assembly includes a third plate positioned so that a food item supported on the second cold plate shelf assembly contacts the third plate, and wherein the third plate is made from a material having a higher thermal conductivity than glass; and an air duct including an air vent, wherein the air duct is configured so that air exiting the air duct through the air vent either impinges on and travels across the third plate or enters an interior of the second cold plate shelf assembly.

20. The refrigerator of claim 19, wherein the second cold plate shelf assembly further includes a frame, and the third plate and frame define a cavity within the second cold plate shelf assembly.

21. The refrigerator of claim 1, wherein the second plate is in direct contact with the top surface of the first plate at a center of the first plate.

22. The refrigerator of claim 1, wherein the second plate is in direct contact with at least a majority of the top surface of the first plate.

23. The refrigerator of claim 1, wherein the second plate is in direct contact with the top surface of the first plate from a front of the first plate to a rear of the first plate.

* * * * *